United States Patent [19]

Winn et al.

[11] Patent Number: 4,941,660

[45] Date of Patent: Jul. 17, 1990

[54] IMPACT AND SPEED MEASURING SYSTEM

[76] Inventors: Donald G. Winn; Daniel M. Josephson, both of 6710 Escondido Dr., Houston, Tex. 77083

[21] Appl. No.: 239,986

[22] Filed: Sep. 2, 1988

[51] Int. Cl.[5] ..... A63B 69/00

[52] U.S. Cl. ..... 272/76; 272/129; 272/DIG. 5; 434/247; 358/22; 73/379; 340/323 R; 273/1 GE; 273/DIG. 28; 364/550

[58] Field of Search ..... 364/550, 518; 272/76, 272/78, 129, DIG. 5; 434/43, 247, 369; 358/183, 181, 22; 73/379; 340/323 R, 724, 721, 747; 273/26 R, 1 E, 1 GE, 183 R, 35 R, DIG. 28

[56] References Cited

U.S. PATENT DOCUMENTS

| | | | |
|---|---|---|---|
| 4,163,941 | 8/1979 | Linn, Jr. | 358/22 X |
| 4,457,716 | 7/1984 | Eserhaut et al. | 434/43 |
| 4,534,557 | 8/1985 | Bigelow et al. | 73/379 X |
| 4,675,736 | 6/1987 | Lehmer et al. | 358/183 |
| 4,713,686 | 12/1987 | Ozaki et al. | 434/369 X |
| 4,763,284 | 8/1988 | Carlin | 364/550 |
| 4,843,483 | 6/1989 | Bogner | 358/22 X |
| 4,883,271 | 11/1989 | French | 272/76 X |

*Primary Examiner*—Richard J. Apley
*Assistant Examiner*—Joe H. Cheng, Jr.
*Attorney, Agent, or Firm*—James A. Bargfrede

[57] ABSTRACT

A high-speed, portable computer interfaced, fluid-filled, foam-padded, heavy bag with local electronic force indicator is provided along with a mechanically-driven paper chart recorder with digital output, split screen video data recording system, and printer for automatic data analysis used to measure a fighter's individual, peak, and total applied force on a target. Such target is constructed so that the fighter feels both familiar and comfortable for each hit, each session, and for such fighter's entire training career spent practicing a bag connected in the system of the present invention. Such system is accurate enough to determine at which point a fighter'punching or kicking muscle groups undergo initial fatigue and subsequent tetanus, or tightening.

1 Claim, 2 Drawing Sheets

IMPACT AND SPEED MEASURING SYSTEM

SUMMARY OF INVENTION

A system is provided for measuring, recording, and reviewing the activities associated with martial arts such as boxing or contact sports, such as football training. Such system records peak force and the total applied force to a bag such as a boxing bag. Previous art devices claimed to measure total applied force, but in scientific fact, did not. The bag has a transducer connected to indicator means which records the speed, power and endurance of punches to the bag. A split screen video component allows viewing of the person punching the bag and also allows viewing of a paper chart recorder which is part of the indicator means. The system is unique in that total applied force is measured and recorded along with the frequency of impact while simultaneously providing video display of the person punching the bag.

DETAILED DESCRIPTION

Figure 1:
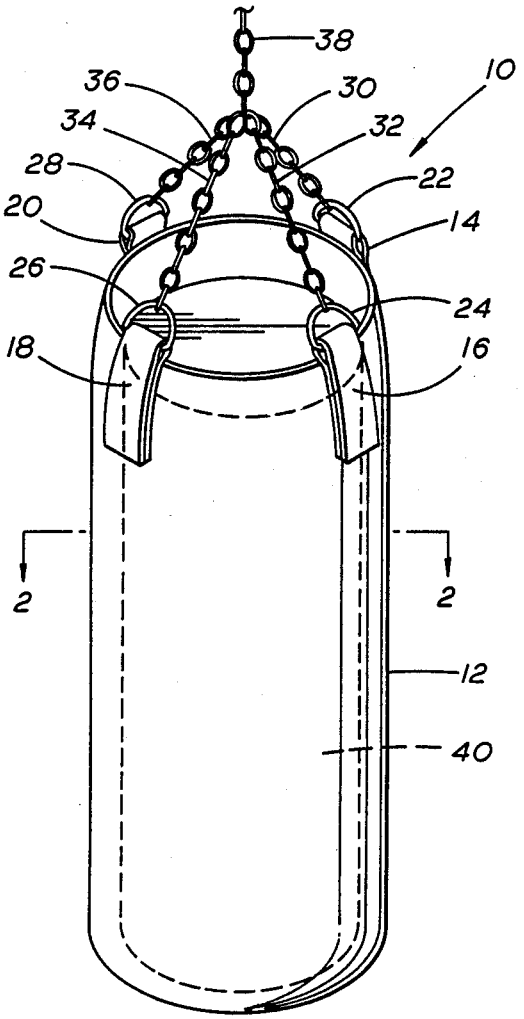
FIG. 1 is an upper, perspective view of a punching bag used in practicing the present invention.

FIG. 1 is an upper, perspective view of a punching bag 10 used in practicing the present invention. An outer bag 12 has a plurality of straps such as strap 14, 16, 18 and 20 in which a plurality of rings such as 22, 24, 26, and 28 are positioned for coupling to chain members 30, 32, 34 and 36. These chain members are connected to support chain 38 which is connected in a manner well-known in the art to which the present invention pertains to allow suspension of the punching bag 10 so that such punching bag may be hit by a boxer or other person training in the martial arts. An inner bag 40 is positioned inside of outer bag 12 as will be explained in detail in connection with FIG. 2.

Figure 2:
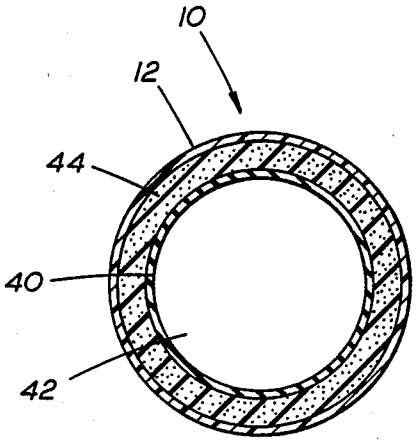
FIG. 2 is an upper, sectional view of the bag taken along line 2—2 of FIG. 1.

FIG. 2 is an upper, sectional view of the punching bag 10 taken along line 2—2 of FIG. 1. Inner bag 40 is filled with chemically preserved water 42 and inner bag 40 has foam 44 positioned on the exterior of inner bag 40 and inside of outer bag 12. Prior to the present invention outer bag 12 had been filled with sawdust and rags. It is well-known in the art of boxing that overwork, or even routine workouts on a conventional heavy bag can cause damage to the hands or wrists of a boxer. It is also known that prior art water-filled bags are not the same diameter as a conventional heavy bag providing less surface than fighters are used to training on and that continued hard hitting to a water wall bag may result in leakage or bursting or tearing of the water bag. A water-filled bag has been described as "feeling more human" to a gloved fist because of the fact that humans are composed largely of water within a membrane or membranes. Fabrication which incorporates foam 44 designed for high impact shock serves several purposes for the punching bag 10 and the fighter who is hitting such bag. The foam increases durability of both the outer bag 12 and the inner bag 40, which is filled with water, by spreading the force of the impact over a larger volume and larger area. Thus, additional diameter is provided and the combination of foam 44 and the inner bag 40 or bladder having water 42 therein provides comfort and safety, both of which have not been found in prior art heavy bags. The arrangement shown in FIG. 2 is an important feature of the present invention for the reasons enumerated previously.

Figure 3:
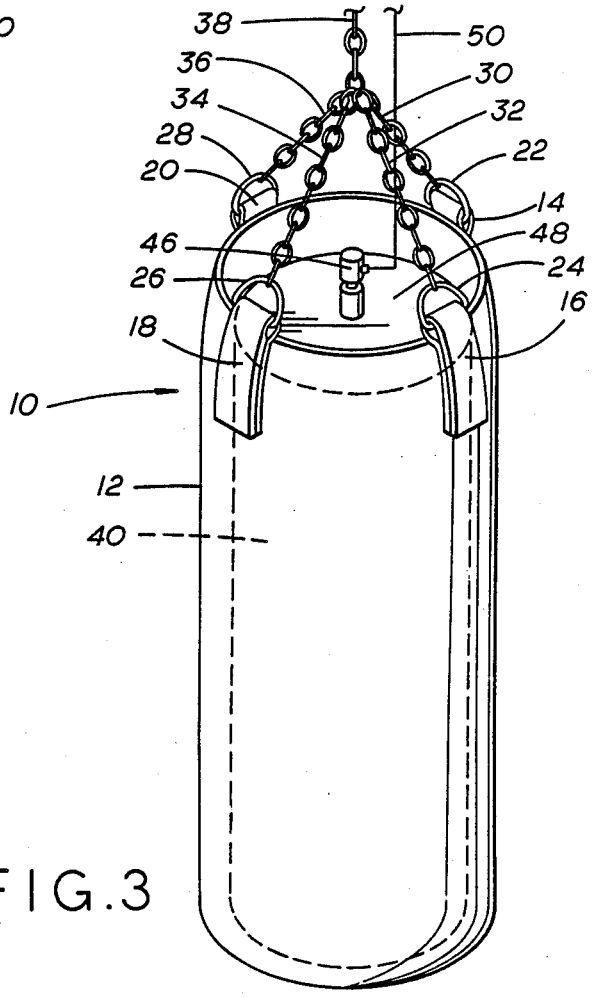
FIG. 3 is an upper perspective view showing the bag of the present invention with a transducer attached thereto.

FIG. 3 is an upper, perspective view showing the punching bag 10 of the present invention with a transducer 46 attached to upper cover 48 of punching bag 10. Conductor 50 is connected to transducer 46 and is connected to equipment in a manner to be explained subsequently in connection with the description of FIG. 4. Transducer 46 is a shock resistant, electronic pressure transducer designed to both withstand, and accurately measure hydraulic slam, and sends an amplified output signal which is proportional to the sum of the applied force on outer bag 12 and inner bag 40 or hydraulic bladder.

Figure 4:
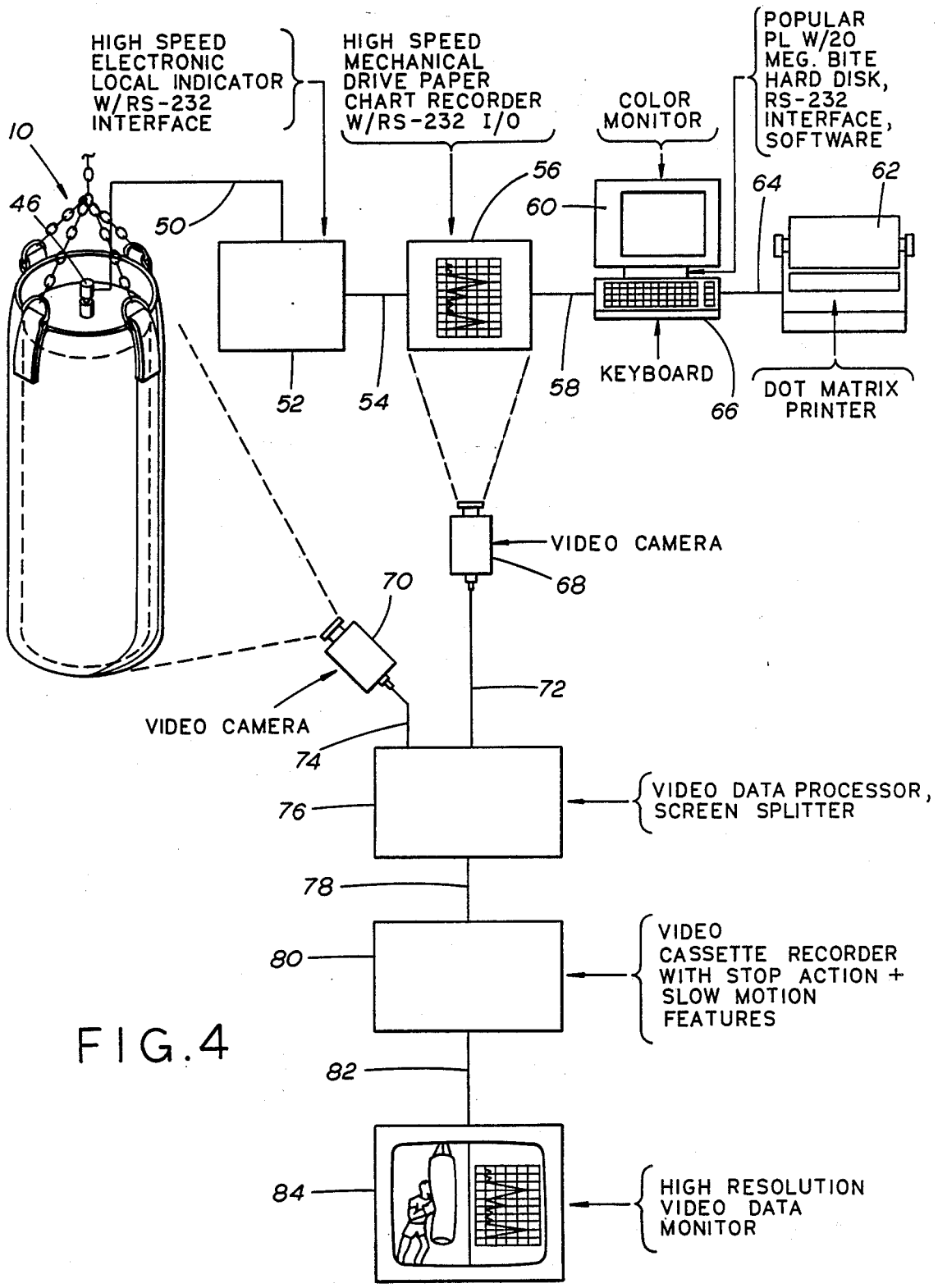
FIG. 4 is partial block diagram and diagrammatic illustration of the system of the present invention.

FIG. 4 is a partial block diagram and diagrammatic illustration of the system of the present invention showing punching bag 10 having transducer 46 connected thereto and coupled through conductor 50 to a locally mounted electronic, high speed, pressure indicator 52 which is equipment compatible for interface and data analysis programs on a standard, desk top computer. Electronic indicator 52 also is equipped with a peak latching circuit which is an approximation of the magnitude of a punch or kick in terms of peak magnitude of the force applied, but is not a measure of total applied force for that peak area, and can be seen by the fighter and by the fighter's trainer during a workout session utilizing the system of the present invention.

The output signal from the electronic indicator 52 is connected through conductor 54 to a mechanical drive, digital output, paper chart recorder 56 equipped with a desk top computer interface port for interface with a desk top computer having similar interface port and data analysis and record keeping programs. Another channel is provided to accommodate pulse and respiration data simultaneous with the applied force data for comparison of the relation between them.

A digitized signal from chart recorder 56 and from electronic indicator 52 is fed through conductor 58 to a popular desk-top computer 60 equipped with a color monitor, floppy disk drive, hard disk drive, keyboard, and dot matrix printer 62 connected through conductor 64. The software of the computer 60 may be comprised of a plurality of individual, known software packages which are linked by a program, or programs written by the inventors of the present invention to provide the overall result of automatic data handling, record keeping, and record comparison with a minimum of keystrokes on keyboard 66 whereby a person totally uninformed and inexperienced concerning computers or typing can learn to operate these relatively complicated tasks in a matter of hours or possibly in minutes. The software provided by the inventors of the present system also provides for an automatic summary of each boxing session to be printed out through the dot matrix printer which includes the total force applied for the entire training session, number of strikes, force of each strike, average force per strike, average strikes per minute, maximum and minimum force strikes and when such strikes occurred, fastest and slowest time between two hits, and the time when the average force per strike starts to decline rapidly, thereby indicating fatigue of the muscles used to strike the punching bag.

Also shown in FIG. 4 is video camera 68 and video camera 70. Video camera 68 allows video taping of the chart recorder 56 at the same time that video camera 70 is video taping the punching bag 10 and fighter. Conductor 72 from video camera 68 and conductor 74 from video camera 70 are connected to a video data processor and screen splitter 76. Conductor 78 connects video data processor and screen splitter 76 to video cassette recorder 80 which has a stop action and slow motion feature. Conductor 82 connects video cassette recorder 80 to high resolution video data monitor 84.

Thus the system of the present invention as shown in FIG. 4 allows video taping of the punching bag 10 and the chart recorder 56 while a fighter is training on the punching bag 10 to provide very valuable feedback on fighting techniques which allow for the improvements to be made after determining how stance, upper body position, speed, and duration of exercise affect the force applied to the punching bag 10 as measured by the chart recorder 56 while the punching bag 10 is being struck, and therefore a fighter may improve his chances of beating an opponent.

The signals from the two video cameras are fed into a video data processor and screen splitter for purposes of being able to show the chart recorder data and the movements of the fighter simultaneously on one screen at the time of viewing. Also, the video signal from the video data processor and screen splitter is fed into a video cassette recorder for purposes of storing and reviewing the data which has been provided by the processor and splitter 76.

Furthermore, the high resolution video data monitor 84 is used for viewing the simultaneous, dual data input from the video cassette recorder 80.

The components used in practicing the present invention are conventional equipment and a representative list of components and vendors of such components is set forth below:

| COMPONENT | VENDOR | PART NO. |
|---|---|---|
| Inner Bag | G. Pacillo Co.<br>P. O. Box 1643<br>Buffalo, NY 14216 | PCB130 |
| High Impact Foam | Home Depot<br>7110 Bellerive<br>Houston, Texas | 587625 |
| Outer Bag | Everlast Sporting<br>Goods Mfg. Co.<br>750 E. 132nd St.<br>Bronx, NY 10454 | x4647 |
| Snubber | Omega Eng. Inc.<br>P. O. Box 2349<br>One Omega Dr.<br>Stamford, CT 069806 | PS4G |
| Pressure Transducer | Omega Eng. Inc.<br>P. O. Box 2349<br>One Omega Dr.<br>Stamford, CT 06906 | PX126-005DV |
| Signal Processor | Omega Eng. Inc.<br>P. O. Box 2349<br>One Omega Dr.<br>Stamford, CT 06906 | DP776 |
| Chart Recorder | Linseis<br>P. O. Box 666<br>Princeton, NJ 08550 | L4000 |
| Computer | Personalized Data<br>Service<br>P. O. Box 5458<br>Pasadena, TX 77508 | Turbo XT |
| Computer Monitor | Magnavox/NAP<br>Knoxville, TN/POSSS<br>37914/Jefferson<br>City, TN 37760 | CM8562 |
| Printer | Panasonic/Matsuihita<br>Two Panasonic Way<br>Secavcus, NJ 07094 | KXP1091I |
| Video Cameras | Panasonic Industrial<br>1825 Walnut Hill Lane<br>Irving, TX 75062 | WV140 |
| Video Processor | RCA Video Equip.<br>Lancaster, PA 17604 | TC1470A |
| Stop Action VCR<br>(Slow Motion) | Panasonic<br>1825 Walnut Hill Ln<br>Irving, TX 75062 | PV4720 |
| 20" High Resolution<br>Video Monitor | Panasonic Industrial<br>1825 Walnut Hill Ln<br>Irving, TX 75062 | WV5490 |

Thus, the system of the present invention provides a combination of elements and a method not known or utilized prior to the present invention. The system of the present invention is computerized and records and analyzes punching during an actual punching session, as opposed to prior art microprocessor-controlled exercise equipment, in which endurance (total power expended on the bag for the entire session and total number of punches per session is recorded), power (total power per punch, not just peak power, although peak power is also included), and speed (time between punches is measured and the number of hits per second and minute is recorded). The system of the present invention includes a chart recorder (local chart recorder displays session on paper where the fighter or trainer can see it as it happens), computer screen (shows peaks as they happen on screen and is also used to view the data after a training session), and optional video system (records both the chart recorder tracing and the fighter hitting the bag simultaneously on video tape for later review by both fighter and trainer).

The system of the present invention analyzes, stores and tracks a fighter's progress or lack of it, for his punching or kicking abilities. If a fighter's punching or kicking power isn't measured and compared, there is no way to estimate how hard the fighter can hit or how well the fighter is being trained.

Also the system of the present invention is hydraulic and includes a special design foam padding around an inner fluid-filled bag. The punching bag of the present invention is safer for the hands and feet, offering more protection than any other known training bag. The punching bag of the present invention feels more like a real opponent in that it feels more like a human and is therefore a more realistic training device.

The present invention fulfills a need in a better, more efficient, and more economical manner than other known training systems and training methods.

Although a preferred embodiment of the invention has been shown and described, it will be appreciated that many modifications and changes may be made without departing from the spirit of the invention defined by the following claims.

We claim:

1. A system for measuring and recording total applied force instead of only peak force associated with martial and boxing arts, said system including in combination bag means vertically supported at the upper end and including a transducer, interface means connected to said transducer, recorder means providing a recording and connected to said interface means, computer means including program means connected to said recorder means, said computer means being comprised of standard components not requiring customizing, dot matrix printer means connected to said computer means for providing the compared results from the computer means, wherein said results including the total applied force instead of only the peak force for an entire training session, number of strikes, force of each strike, average force per strike, average strikes per minute, maximum and minimum force strikes and when such strikes occurred, fastest and slowest time between two strikes, and the time when the average force per strike starts to decline rapidly to indicate fatigue of the muscles used to strike said bag means so that progress of training may be ascertained, first and second video cameras, said first video camera being focused on said bag means and said second video camera being focused on said recorder means, video data processor means connected to said first and second video cameras, video cassette recorder means connected to said video data processor means, and video data monitor means connected to said video cassette recorder means whereby said bag means and the person applying a plurality of intermittent strikes to said bag means is displayed in synchronization alongside the total applied force from each of said plurality of intermittent strikes.

* * * * *